US005078611A

United States Patent [19]

Tanigawa et al.

[11] Patent Number: 5,078,611

[45] Date of Patent: Jan. 7, 1992

[54] ELECTRICAL CONNECTOR AND ELECTRIC CONTACT THEREFOR

[75] Inventors: Junichi Tanigawa, Kawasaki; Shoji Kikuchi, Hiratsuka, both of Japan

[73] Assignee: AMP Incorporated, Harrisburg, Pa.

[21] Appl. No.: 648,719

[22] Filed: Jan. 31, 1991

[30] Foreign Application Priority Data

Feb. 1, 1990 [JP] Japan ..... 2-20486

[51] Int. Cl.[5] ..... H01R 9/09

[52] U.S. Cl. ..... 439/78; 439/83; 439/876; 439/907

[58] Field of Search ..... 439/78-83, 439/843-845, 873, 876, 884, 907, 908

[56] References Cited

U.S. PATENT DOCUMENTS

| | | | |
|---|---|---|---|
| 3,270,251 | 8/1966 | Evans | 439/80 |
| 3,596,235 | 7/1971 | Gerardus et al. | 439/907 |
| 4,808,113 | 2/1989 | Kanesige et al. | 439/83 |
| 4,917,614 | 4/1990 | Kikuchi et al. | 439/83 |
| 4,918,813 | 4/1990 | Mori et al. | 439/78 |
| 4,992,056 | 2/1991 | Douty et al. | 439/83 |

FOREIGN PATENT DOCUMENTS

| | | |
|---|---|---|
| 135988 | 3/1985 | European Pat. Off. . |
| 269241 | 6/1988 | European Pat. Off. . |
| 290300 | 11/1988 | European Pat. Off. . |

*Primary Examiner*—Paula A. Bradley

*Attorney, Agent, or Firm*—Adrian J. LaRue; Allan B. Osborne

[57] ABSTRACT

An electrical connector (10,20,30,40) having an insulating housing (11,21,31,41) and electric contacts (14,24,34,44) therein has been disclosed. The electric contacts (14,24,34,44) are individually formed by removing selected parts (53,55,56,58,59,61,62) from stamped electric contact elements (50). The housing (11,21,31,41) includes cavities (12,32) opening on a front surface and cavities (22,42) opening on a back surface.

10 Claims, 2 Drawing Sheets

ELECTRICAL CONNECTOR AND ELECTRIC CONTACT THEREFOR

FIELD OF THE INVENTION

The present invention refers to an electrical connector and in particular, to a connector which is suitable for attaching to a circuit substrate and for connecting flat cables and other insulated wires; and to an electric contact which can be used with it.

BACKGROUND OF THE INVENTION

Electrical connectors in a variety of shapes and dimensions are presently being used in a variety of electronic devices and electronic application devices. Electrical connectors are generally used to connect electronic circuits which have been formed on circuit substrates with flat cables and other insulated wires which themselves are connected to electronic parts and electronic devices.

Electrical connectors are configured of an insulated housing and one or more electrical contacts. The number of contacts used in the electrical connector is growing all the time as electronic devices become more sophisticated and more high powered and as the density is increased due to the demand for small devices. What is more, there are two types of connection between the electric contact and the circuit substrate: (1) the lead-type which is inserted and stabilized in an opening on the circuit substrate and (2) the surface mounting type (SMT) which is connected by soldering it onto the contact pad of the surface of the circuit substrate. The technique in which lead-types are formed in a zigzag fashion to increase the density of the mounting is well known.

In spite of this, there are the following defects. Not only were manufacturing tools or press-type molds required to prepare separately the different electric contacts on the electrical connector which is used in a number of variations above, but each of the electric contacts manufactured had to be stored and taken care of separately which led to increased costs. These defects cannot be ignored since the manufacturing costs increased with the greater variety of electrical connectors manufactured.

As a result, it is an object of the present invention to provide an electrical connector and an electric contact for it which are suitable for a great variety of electrical connectors which are manufactured in small quantities.

DESCRIPTION OF THE INVENTION

Figure 1:
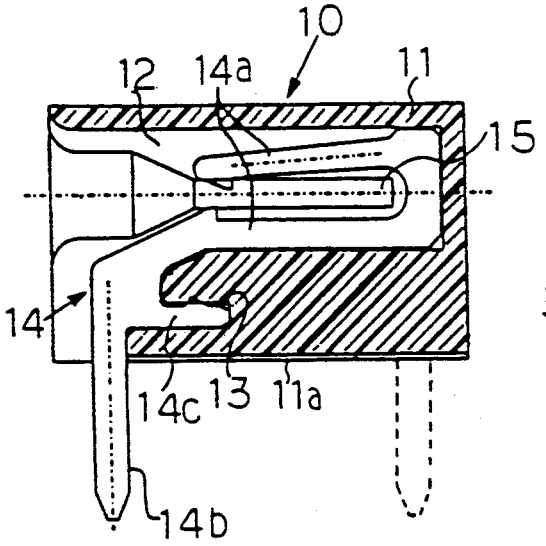
FIG. 1 through FIG. 4 are cross-sections of each of the different practical examples of the electrical connector in the present invention.
Figure 3:
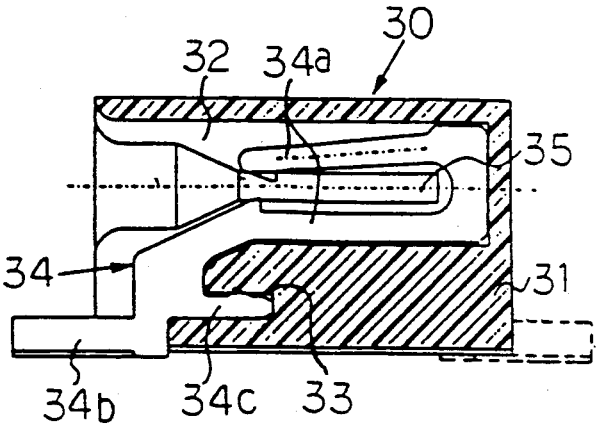
Figure 2:
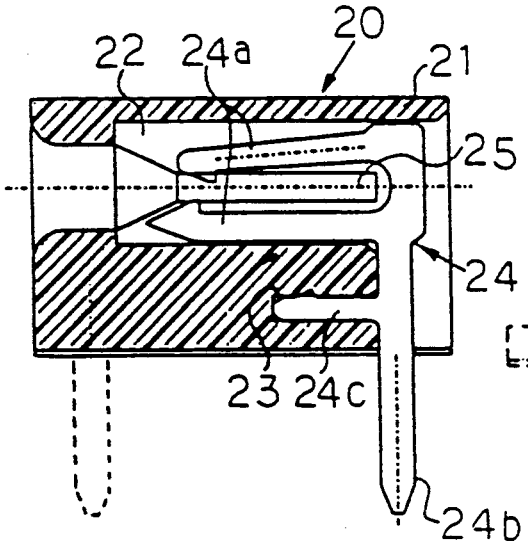
Figure 4:
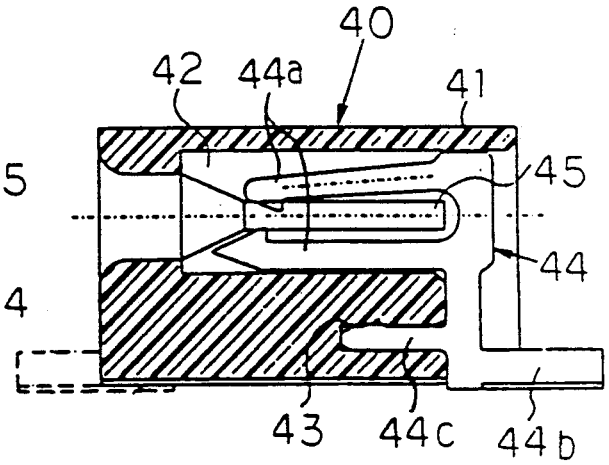

FIG. 1 through FIG. 4 are cross-sections of a number of variations of the electrical connector in the present invention. FIG. 1 and FIG. 2 indicate the electrical connector which is equipped with lead-types which are inserted and connected in the through holes and other openings in the circuit substrate. FIG. 3 and FIG. 4 are practical examples of the surface mounting type (SMT) of the electrical connector which is connected by soldering to a conductive pad on the surface of the circuit substrate.

First we shall refer to FIG. 1. Electrical connector 10 is equipped with insulated housing 11 which is rectangular when seen in cross-section. This insulated housing 11 is such that its bottom surface 11*a* is loaded onto the circuit substrate and other attachable plate-shaped members (not shown in diagram) and is equipped with a large first cavity 12 which extends to the back surface from the front surface and is parallel to the bottom surface and a small second cavity 13 on the bottom. These first and second cavities 12 and 13 are generally parallel to each other when seen on a sheet of paper and are separated from one another and numbers of them are formed at specific intervals. Electric contacts 14 are inserted and retained from the front in the first and second pairs of cavities 12 and 13.

Each of the electric contacts 14 in the practical example is configured of a retaining part 14*c* with a barb attached which extends horizontally from the base part of connection part 14*b* and of a connection part 14*b* where it connects with the plate-shaped member which extends downward through the bottom surface 11*a* of the insulating housing 11 from the fork-shaped or hook-shaped contact part 14*a* which is made up of an upper and a lower contact piece and the front end of the lower side of the contact piece. As can be seen from the diagram, contact part 14*a* and retaining piece 14*c* on electric contact 14 are press-fitted respectively into the first cavity 12 and the second cavity 13 in insulated housing 11 so that each of the electric contacts 14 is retained securely inside insulated housing 11.

Each of the electric contacts 14 should be formed by blanking from a metal sheet. Contact part 14*a* should be inclined so that the intervals on both contact pieces become narrower the more they face the front; at the same time, a contact protrusion should be formed by shifting some positions which lie in the horizontal direction towards the inside of the front end. Opening 15 which is (a) aligned with the contact part 14*a* of the electric contact 14 and (b) in which the conductive front part of a ribbon (flat) cable and others or the contact pin of another connector is inserted is formed in the insulated housing 11.

Next, the electrical connector 20 in FIG. 2 is similar to electrical connector 10 in FIG. 1. It is equipped with insulated housing 21 which is equipped with first and second cavities 22 and 23 and electric contacts 24. First and second cavities 22 and 23 open onto the back surface of insulated housing 21. Electric contact 24 is equipped with the same type of contact part 24*a* as is electric contact 14. However, connection part 24*b* and retaining part 24*c* are formed on the bottom part of the lower end of the shared joined parts of fork-shaped contact part 24*a*. In this electric contact 24, contact part 24*a* and retaining part 24*b* are press-fitted and retained from the rear. It is similar to the electrical connector in FIG. 1 in that more than one of this same contact 24 can be formed at specific intervals and a conductor or a contact pin is inserted into opening 25 from the front surface of insulated housing 21 and is connected to contact part 24*a*.

Further, a high-density electrical connector can be obtained by combining the electrical connectors 10 and 20 in FIG. 1 and FIG. 2, forming openings for each of the cavities on the insulated housing and press-fitting electric contacts 14 and 24 from the front and the back to form a staggered zigzag shape. The electric contacts especially the connection parts, for the electrical connector which is configured in this way is indicated by the dotted line in FIG. 1 and FIG. 2. In this case, the insulated housing is attached to the plate-shaped member at the front and at the back so that the density is increased and the attaching strength is improved. Needless to say, the contact parts should be arrayed on the same surface.

Next, we shall refer to FIG. 3 and FIG. 4 to describe electrical connectors 30 and 40 which are equipped with the surface mounting type terminal. Electrical connectors 30 and 40 in FIG. 3 and FIG. 4 are different in that electric contact 34 on the former is press-fitted and retained from the front surface of insulated housing 31 and electric contact 44 on the latter is press-fitted and retained from the rear surface. Both electric contacts 34 and 44 are equipped with the same type of contact parts 34*a* and 44*a* disposed in cavities 32, 42 of housing 31, 41 and the same type of retaining parts 34*c* and 44*c* are secured in cavities 33, 43 of housings 31, 41. However, connection parts 34*b* and 44*b* are of the surface mounting type which makes contact with and is connected to the conductive pad (not shown in Figure) on the circuit substrate and on the surface of other plate-shaped members. Surface mounting type terminals 34*b* and 44*b* may be the end surfaces of the individual plate-shaped electric contact points, however, part of them may be bent and shaped at a right angle and the area which makes contact with the conductive pad may be increased to improve the connecting and retaining strength. Even in the surface mounting type (SMT) electrical connector in FIG. 3 and FIG. 4, this may be formed by arranging only identical multiple electric contacts so that they are parallel. However, it may be configured by press-fitting and retaining the electric contacts in FIG. 3 and FIG. 4 inside the insulating housing from the opening on the front surface and the back surface (in the figure, other connection parts are indicated by a dotted line). This staggered array is especially suitable for high-density type electrical connectors. Openings 35, 45 are located in housings 31, 41 in alignment with contact parts 34*a*, 44*a*.

As stated previously, it is extremely uneconomical to manufacture separately the electric contacts 14, 24, 34 and 44 for the electrical connectors 10, 20, 30 and 40 in FIGS. 1 through FIG. 4 above. Therefore, we shall next refer to FIG. 5 to describe an electric contact element which can be used as an electric contact with each of the different types of electrical connector.

This electric contact element 50 forms fork-shaped contact part 52 from a pair of upper and lower contact pieces 51*a*, 51*b*. It is equipped with connection parts/retaining parts 53*a*, 53*b* on both end parts of the lower side of contact piece 51*b*. These connection/retaining parts 53*a*, 53*b* extend so that they form a right angle with contact part 52. Connection part/retaining part 53*a* is equipped with (1) a retaining part 54 which has a barb, (2) lead-type connection part 55 and (3) surface mounting type (SMT) connection part 56. Meanwhile, connection part/retaining part 53*b* is equipped with (1) a retaining part 57 which has a barb, (2) lead-type connection part 58 and (3) surface mounting type (SMT) connection part 59.

Figure 5:
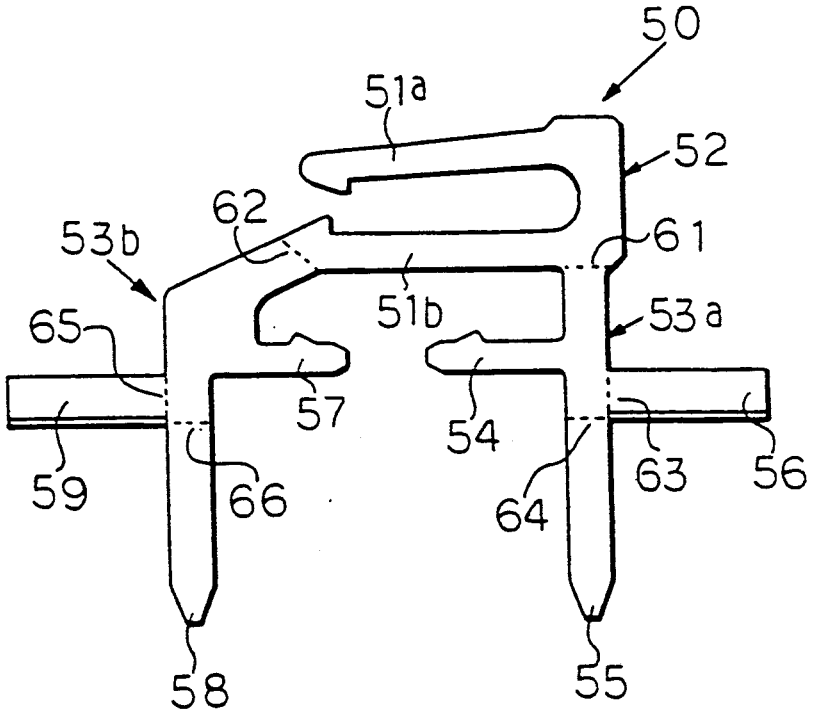
FIG. 5 is a frontal view of a practical example of the electric contact element for use in the electrical connector in FIG. 1 through FIG. 4 by selectively removing parts therefrom.

Electric contact element 50 in FIG. 5 is used to obtain electric contacts 14, 24, 34 and 44 for electrical connectors 10, 20, 30 and 40 by cutting a part of electric contact element 50 selectively at specific position which are indicated in the figure. First, the electrical contact element is cut on dotted lines 61 and 65 in order to obtain the electric contact 14 in FIG. 1. The connection part/retaining part 53*a* on the right side is cut away using this process and the surface mounting type (SMT) connection part 59 on the left side is cut away as well. As a result, we can obtain electrical connector 10 which is equipped with an electrical contact 14 which is press-fitted from the front and which itself is equipped with substrate through-type lead-types. When lead-type connection part 58 is cut away on dotted line 66 instead of on dotted line 65 as done previously, we can obtain an electric contact 34 for use with an electrical connector 30 which can handle the surface mounting type which uses press-fitting on the front surface as is indicated in FIG. 3.

Next, when we cut on dotted lines 62 and 63, we obtain the lead-type electric contact for use with the electrical connector 20 in FIG. 2. When we cut on dotted line 64 instead of on dotted line 63, we can obtain an electric contact 44 which can handle the surface mounting type used in the electrical connector 40 indicated in FIG. 4.

As seen from above, we can carry out an assembly of an electrical connector by using a shared electric contact element 50 which is equipped with a fork-shaped contact part 52, by leaving the required retaining part and the connection part and by cutting away the unnecessary retaining part and connection part. This electric contact element 50 can be supplied or stored by coupling it to a carrier strip at the front end of lead-type connection parts 55 and 58 and by rolling multiple electric contacts to form a spiral shape. Furthermore, the insulated housing and the circuit substrate and other plate-shaped members may be stabilized by using the connection part itself and an attached or separate attaching and retaining arm may be used if necessary.

As can be seen from the previous explanation, the electrical connector in the present invention is equipped with a fork-shaped contact part which is parallel to the surface of the attaching plate-shaped member and uses a plate-shaped electric contact which can be inserted either from the front surface or the rear surface of the insulated housing. This electric contact is equipped with a barbed retaining part which is press-fitted into a retaining cavity inside the insulated housing at the same time that the contact part is inserted near the base part of the connection part. As a result, it can be retained securely inside the insulated housing and can have a sufficiently low-profile structure. In addition, a lead-type or a surface mounting type connection part may be selected for the circuit substrate and other plate-shaped members. The electrical connector may be attached to the plate-shaped member by virtue of its high density and its sufficient strength by inserting and retaining the electric contacts from the openings on the front surface and the back surface of the insulated housing. Furthermore, each of the electric contacts is positioned inside from the front surface and the back surface of the insulated housing and they are isolated from each other by a partition so that there is no possibility of their coming into contact with another conductor part.

The electric contact for use with the electrical connector in the present invention is equipped with a shared horizontal-type contact part as well as a pair of connection parts/retaining parts which are used by cutting them away. The connection parts are equipped with both lead-type and surface mounting type connection parts. As a result, a variety of different electric contacts for an electrical connector can be used in common so that manufacturing costs can be lowered and maintenance expenses can be greatly reduced.

We claim:

1. An electrical connector, comprising:

an insulated housing having contact-receiving cavities extending into said housing from a front surface and a rear surface and securing cavities extending into said housing from the front and rear surfaces spaced from said contact-receiving cavities; and electrical contacts having contact sections disposed in said contact-receiving cavities, retaining sections secured in said securing cavities and removable lead-type connection sections and surface-mounting type connection sections.

2. An electrical connector as claimed in claim 1, wherein the electrical contacts include a removable connection section/securing section adjacent a rear end of the contact section and a removable connection section/securing section adjacent a front end of the contact section.

3. An electrical connector for electrical connection to through holes or surface-mounting pads of a circuit board, comprising:

an insulated housing having contact-receiving cavities extending into said housing from a front surface and securing cavities extending into said housing from the front surface spaced from said contact-receiving cavities; and electrical contacts having contact sections disposed in said contact-receiving cavities, retaining sections secured in said securing cavities and removable lead-type connection sections and surface-mounting type connection sections so that upon removal of said surface-mounting type connection sections said lead-type connection sections are positionable in through holes of the circuit board and upon removal of the lead-type connection sections the surface-mounting type connection sections are engageable with the surface-mounting pads of the circuit board.

4. An electrical connector as claimed in claim 3, wherein the electrical contacts include a removable connection/securing section adjacent a rear end of the contact section and a removable connection/securing section adjacent a front end of the contact section.

5. An electrical connector as claimed in claim 3, wherein contact-receiving cavities and securing cavities extend into said housing from a rear surface of said housing so that said contact sections and securing sections of said contacts are disposed and secured in the contact-receiving and securing cavities with lead-type or surface-mounting connection sections extending outwardly from the bottom or rear surfaces of said housing.

6. An electrical connector as claimed in claim 5, wherein said contact-receiving and securing cavities that extend into the housing from the rear surface of the housing are staggered with respect to said contact-receiving and securing cavities that extend into the housing from the front surface.

7. An electrical contact comprising:

a contact section;

removable connection section and securing section adjacent a rear end of said contact section; and removable connection section and securing section adjacent a forward end of said contact section.

8. An electrical contact as claimed in claim 7, wherein said contact section has a fork shape.

9. An electrical contact as claimed in claim 7, wherein each said removable connection and securing sections includes a removable lead-type connection section and a removable surface-mounting type connection section.

10. An electrical connector having a plurality of contacts secured in parallel relationship in an insulated housing to make electrical contact with ends of parallel electrical conductors received from the front face of said insulated housing and conductors on a circuit board on which said electrical connector is mounted, characterized in that:

said insulated housing includes first cavities substantially parallel to the circuit board and second cavities substantially parallel to said first cavities and extending alternately from the front and rear surfaces of said insulated housing; and a plurality of first and second contacts each having a contact section to be received in said respective first cavities, a barbed retention section to be securably inserted in said respective second cavities and a connection section to be connected to the conductors on the circuit board;

wherein said first contacts are loaded from the front surface of said insulated housing and said second contacts are loaded from the rear surface in an interdigitated manner.

* * * * *